US006563416B1

(12) United States Patent
Zintler

(10) Patent No.: US 6,563,416 B1
(45) Date of Patent: May 13, 2003

(54) LOCKING DEVICE FOR A MOTOR VEHICLE HAVING A NUMBER OF DOORS

(75) Inventor: Albert Zintler, Gross-Gerau (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/460,287

(22) Filed: Dec. 9, 1999

(30) Foreign Application Priority Data

Dec. 11, 1998 (DE) ..... 198 57 176

(51) Int. Cl.[7] ..... G06F 7/04

(52) U.S. Cl. ..... 340/5.31; 340/5.64; 340/426; 340/539

(58) Field of Search ..... 340/5.31, 5.28, 340/5.51, 5.64, 5.72, 425.5, 426, 574, 539; 307/10.1, 10.2, 10.5; 361/172

(56) References Cited

U.S. PATENT DOCUMENTS

| | | | | |
|---|---|---|---|---|
| 3,725,939 A | | 4/1973 | Saltzstein | 340/825.77 |
| 4,859,990 A | * | 8/1989 | Isaacman | 340/539 |
| 5,532,709 A | | 7/1996 | Talty | 343/819 |
| 5,546,072 A | * | 8/1996 | Creuseremee et al. | 340/574 |
| 5,710,548 A | * | 1/1998 | LeMense | 340/825.69 |
| 5,723,912 A | * | 3/1998 | Ahrabian et al. | 307/10.1 |
| 6,292,107 B1 | * | 9/2001 | Yamaura et al. | 340/825.69 |

FOREIGN PATENT DOCUMENTS

| | | |
|---|---|---|
| DE | 3546490 | 12/1986 |
| DE | 4403655 | 8/1995 |
| DE | 19619011 | 11/1997 |
| DE | 19639896 | 4/1998 |
| DE | 19720765 | 11/1998 |
| EP | 0138090 | 4/1985 |
| EP | 0257212 | 3/1988 |
| EP | 0343619 | 11/1989 |
| EP | 0741221 | 11/1996 |
| EP | 0774673 | 5/1997 |

* cited by examiner

*Primary Examiner*—Van Trieu
(74) *Attorney, Agent, or Firm*—Martin A. Farber

(57) ABSTRACT

A locking device for a coach (13) has a control device (20) for detecting a position of a portable transmitter (21). The control device (20) drives, in dependence on the position of the transmitter (21), locks (24, 25) that locks doors (22, 23) of the coach (13) which are provided exclusively for this position. As a result of this, unrequired doors (22, 23) do not have to be monitored.

6 Claims, 1 Drawing Sheet

LOCKING DEVICE FOR A MOTOR VEHICLE HAVING A NUMBER OF DOORS

FIELD AND BACKGROUND OF THE INVENTION

The invention relates to a locking device for a motor vehicle having a number of doors, a portable transmitter and a receiver, to be arranged on the motor vehicle, for a code of the transmitter, and a control device for driving locks of the doors.

Such locking devices are frequently used in contemporary motor vehicles and are known from the art. In this case, the transmitter to be carried by the driver of the motor vehicle transmits a code which is fed to the control device by the receiver and evaluated in said control device. After checking the code, the control device drives a central locking arrangement for the doors and frequently an immobilizer of the motor vehicle as well.

The known locking device has the disadvantage that, particularly in the case of vehicles that are not wholly observable, such as buses or delivery vehicles for example, it opens doors which are out of sight of the driver. The locking device becomes highly inconvenient as a result of this, since, in order to afford protection against theft, the doors have to be monitored for example in a costly fashion using mirrors or other persons.

SUMMARY OF THE INVENTION

The invention is based on the problem of providing a locking device of the introductory mentioned type such that the doors can reliably be driven in a particularly convenient manner, and the monitoring of the open doors by the person carrying the transmitter becomes particularly simple.

This problem is solved according to the invention wherein the control device has means for detecting the position of the transmitter and is provided for exclusively driving at least one of the locks provided in dependence on the position of the transmitter.

This configuration makes it possible to define doors that are to be driven by the control device in accordance with the position of the transmitter. As a result of this, in the case of a parcel service vehicle, for example, it is possible to unlock exclusively the driver's door or the rear door or one of a plurality of lateral sliding doors or a combination of the doors. A person carrying the transmitter therefore has highly convenient access to the motor vehicle without having to monitor other doors.

In accordance with an advantageous development of the invention, the control device becomes particularly cost-effective if means for detecting the position of the transmitter have a plurality of antennas, and if the control device is adapted for evaluating the signals of the antennas for determining the position of the transmitter. In the simplest case, the control device merely has to identify the antenna which receives the signals from the transmitter.

In accordance with another advantageous development of the invention, the position of the transmitter can be determined particularly accurately if the antennas are configured as directional antennas.

The locking device according to the invention has a particularly low power consumption if the control device has a transmission antenna that is provided for generating a start signal with respect to the portable transmitter.

The transmitter could, for example, have an accumulator as its own power supply. However, constant checking of a charge state of the accumulator can be avoided, in accordance with another advantageous development of the invention, if the start signal is assigned an activation energy for the transmitter.

It is frequently undesirable for the code that activates the control device to be radiated continuously, since it could be recorded and copied or passed on. Improper recording of the code can be reliably avoided, in accordance with another advantageous development of the invention, if the transmitter has an actuating element for radiating a code.

The locking device according to the invention can be used in a simple manner for driving a plurality of locks if the portable transmitter has a plurality of code generators. By virtue of an appropriate arrangement of the code generators on different transmitters, the locking device according to the invention forms a particularly convenient system for the targeted release of locks by different persons. As a result of this, the driver of the motor vehicle can, for example, use the transmitter to deactivate an immobilizer of the motor vehicle and start the engine, while a passenger just has a code generator for opening the doors. Since a plurality of code generators are arranged on a single transmitter, it becomes unnecessary to search for the transmitter provided for the envisaged application.

In accordance with another advantageous development of the invention, the portable transmitter becomes particularly cost-effective if it has a passive code generator with a stored code.

In accordance with another advantageous development of the invention, copying the code can be prevented in a simple manner if the portable transmitter has an active code generator for calculating a code after the start signal, containing a code, of the control device. By way of example, a microprocessor with a memory is suitable as the active code generator.

In accordance with another advantageous development of the invention, the monitoring of the doors by the person carrying the transmitter becomes particularly convenient if the control device is provided for locking the doors when the transmitter is removed from the reception range of the receiver.

In a locking device for a bus or for a transporter in which the doors are arranged on different sides it becomes particularly difficult to monitor those doors which are situated on the opposite side to the person carrying the transmitter. In the case of such buses, the monitoring becomes particularly convenient if the control device is provide for exclusively driving at least one of the doors present on the side of the transmitter. As a result of this, particularly in the case of coaches having a multiplicity of doors for luggage which are arranged on their long sides and are designed as flaps, the risk of theft can be kept particularly low.

BRIEF DESCRIPTION OF THE DRAWINGS

The invention permits numerous embodiments. In order to further elucidate its basic principle, two of these embodiments are illustrated in the drawings and are described below. In said drawings.

DETAILED DESCRIPTION OF THE PREFERRED EMBODIMENT

Figure 1:
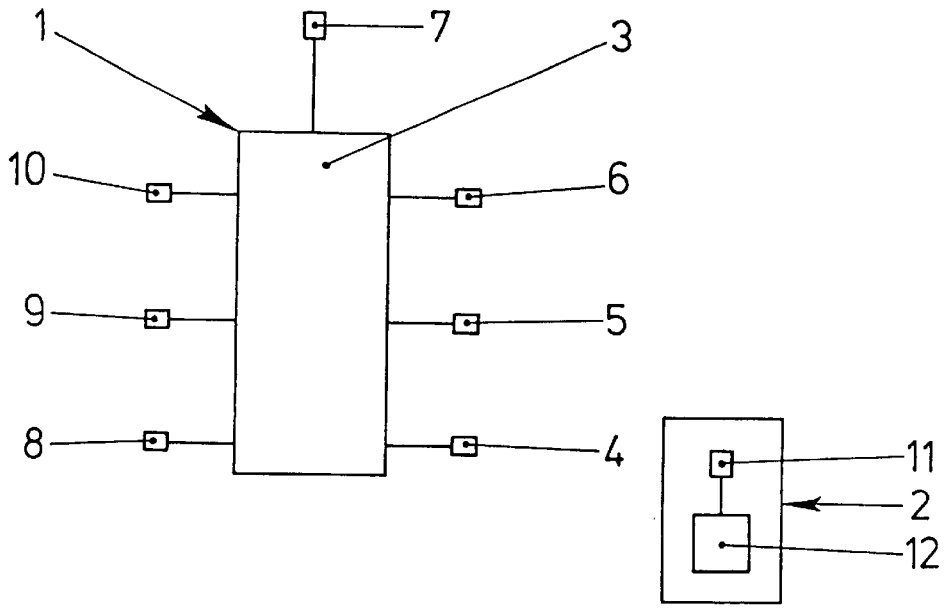
FIG. 1 shows a schematic illustration of a locking device according to the invention.

FIG. 1 shows a locking device according to the invention for a motor vehicle with a receiver 1 and a portable transmitter 2. The receiver 1 has a control device 3 with a plurality of antennas 4–7 and is connected to three electrically drivable locks 8–10 of the motor vehicle. The locks 8–10 serve for unlocking or locking doors (not illustrated) of a motor vehicle. The transmitter 2 has an antenna 11 and a code generator 12.

One of the antennas 7 connected to the control device 3 serves for radiating a start signal and activation energy for the transmitter 2. As soon as the transmitter 2 enters the reception range of the receiver 1, it transmits a code, which is received by at least one of the remaining antennas 4–6. The control device 3 evaluates the code and, with the aid of a stored code, checks whether there is authorization for unlocking the locks 8–10. Furthermore, it determines the approximate position of the transmitter 2 with the aid of the signals forwarded to it by the antennas 4–6. In dependence on the position of the transmitter 2, only one or an intended number of the locks 8–10 is or are subsequently driven and thus unlocked. This enables the person carrying the transmitter 2 to open the intended doors of the motor vehicle in a highly convenient manner. All of the remaining doors remain locked and do not, therefore, have to be monitored.

Figure 2:
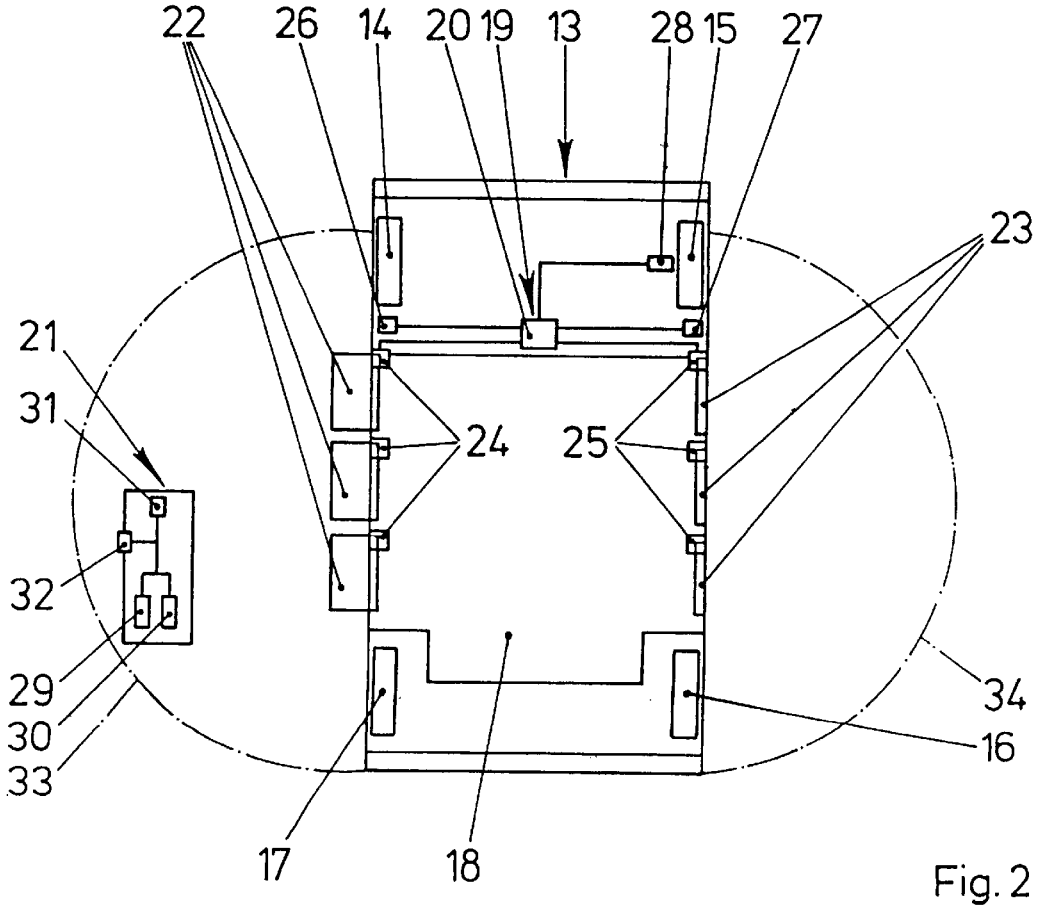
FIG. 2 shows a schematic illustration of a coach with a further embodiment of the locking device according to the invention.

FIG. 2 schematically shows a cross section through a coach vehicle 13 through a luggage compartment 18 arranged underneath rows of seats (not illustrated) and between wheels 14–17. A receiver 19 with a control device 20 of a locking device according to the invention is arranged in the coach 13. Outside the coach 13 there is a transmitter 21, which can be carried by a driver of the coach 13, for example. The luggage compartment 18 can be locked by doors 22, 23 which are arranged on both sides of the coach 13 and are designed as flaps. The doors 22, 23 designed as flaps can be locked by electrically drivable locks 24, 25. The control device 20 of the receiver 19 is connected to the locks 24, 25 and to two antennas 26, 27. Furthermore, the control device 20 is connected to an electronic immobilizer 28. The transmitter 21 has two code generators 29, 30, an antenna 31 and an actuating element 32.

A code from one of the code generators 29, 30 can optionally be transmitted using the actuating element 32. The antennas 26, 27 of the receiver 19 are designed as directional antennas and each have a reception range 33, 34 extending over one side of the coach 13, said reception range being illustrated by dashed-dotted lines in the drawing. The code transmitted by the transmitter 21 is captured only by that antenna 26, 27 in whose reception range 33, 34 the transmitter 21 is located. The control device 20 evaluates the code and unlocks those doors 22, 23 designed as flaps which are situated on the side of the transmitter 21, or it deactivates the immobilizer 28. Those doors 22, 23 designed as flaps which are situated on the opposite side of the transmitter 21 remain locked.

Instead of the large reception ranges 33, 34 extending over the entire side of the coach 13, it is also possible, of course, to provide a plurality of small reception ranges arranged in the region of the doors 22, 23 designed as flaps. This would make it possible for the doors 22, 23 designed as flaps to be locked or unlocked individually.

I claim:

1. A locking device for a motor vehicle having a number of doors, having a portable transmitter and a receiver, to be arranged on the motor vehicle, for a code of the transmitter, and having a control device for driving locks of the doors, wherein the control device (3, 20) has means for detecting position of the transmitter (2, 21) and is for exclusively driving at least one of the locks (8–10, 24, 25) provided in dependence on the position of the transmitter (2, 21), wherein the control device (3) has an antenna (7) that is provided for radiating a start signal to a portable transmitter (2), wherein the portable transmitter (21) has a plurality of code generators (29, 30).

2. The locking device as claimed in claim 1, wherein each of the plurality of code generators generates a unique code, each unique code driving a respective lock.

3. The locking device as claimed in claim 2, further comprising a plurality of transmitters, each transmitter including a plurality of code generators.

4. A locking device for a motor vehicle having a number of doors, having a portable transmitter and a receiver, to be arranged on the motor vehicle, for a code of the transmitter, and having a control device for driving locks of the doors, wherein the control device (3, 20) has means for detecting position of the transmitter (2, 21) and is for exclusively driving at least one of the locks (8–10, 24, 25) provided in dependence on the position of the transmitter (2, 21), wherein the control device (3) has an antenna (7) that is provided for radiating a start signal to a portable transmitter (2), wherein the portable transmitter (3, 21) has an active code generator (12, 29, 30) for calculating a code after the start signal, containing a code, of the control device (3, 20).

5. A locking device for a motor vehicle having a number of doors, having a portable transmitter and a receiver, to be arranged on the motor vehicle, for a code of the transmitter, and having a control device for driving locks of the doors, wherein the control device (3, 20) has means for detecting position of the transmitter (2, 21) and is for exclusively driving at least one of the locks (8–10, 24, 25) provided in dependence on the position of the transmitter (2, 21), wherein the control device (20) is for locking the doors (22, 23) when the transmitter (21) is removed from reception range (33, 34) of the receiver (19).

6. A locking device for a motor vehicle having a number of doors, having a portable transmitter and a receiver to be arranged on the motor vehicle, for receiving a code signal transmitted by the transmitter, and having a control device for driving locks of the doors, wherein the control device (3, 20) has means for detecting position of the transmitter (2, 21) and is for exclusively driving at least one of the locks (8–10, 24, 25) dependent on the proximity of the transmitter (2, 21) to at least one door associated with the at least one of the locks, wherein said means for detecting the position of the transmitter (2, 21) have a plurality of antennas (4–6, 26, 27), and wherein the control device (3, 20) is for evaluating the signals of the antennas (4–6, 26, 27) for determining the position of the transmitter (2, 21), wherein the antennas (4–6, 26, 27) are configured as directional antennas, wherein one of the plurality of directional antennas is positioned at an ignition lock of the motor vehicle for driving the ignition lock upon receipt of a transmission lock code signal by said transmitter.

* * * * *